United States Patent [19]

Brady et al.

[11] Patent Number: 4,538,551

[45] Date of Patent: Sep. 3, 1985

[54] REFRACTORY CHOKE FOR A HIGH INTENSITY COMBUSTOR

[75] Inventors: Robert T. Brady, Elmhurst; Harry L. Gardell, Hoffman Estates, both of Ill.

[73] Assignee: Vapor Corporation, Chicago, Ill.

[21] Appl. No.: 622,667

[22] Filed: Jun. 20, 1984

[51] Int. Cl.[3] ..... F22B 23/06

[52] U.S. Cl. ..... 122/367 R; 122/367 C; 431/278; 431/183; 404/31; 404/45

[58] Field of Search ..... 122/367 R, 367 C; 431/278, 183; 404/31, 45; 165/185

[56] References Cited

U.S. PATENT DOCUMENTS

| | | | |
|---|---|---|---|
| 2,179,019 | 11/1939 | Willets | 404/31 |
| 2,317,963 | 4/1943 | Bashore | 404/45 |
| 3,226,038 | 12/1965 | Brady et al. | 431/278 |
| 3,429,094 | 2/1969 | Romuladi | 106/97 |
| 3,500,728 | 3/1970 | Longini et al. | 404/31 |
| 3,601,015 | 8/1971 | Kilstofle | 404/45 |

*Primary Examiner*—Henry C. Yuen

*Attorney, Agent, or Firm*—Francis J. Lidd

[57] ABSTRACT

A boiler includes a high intensity combustor mounted in a shell that defines the boiler housing. A coil bank is mounted in the boiler and spaced from the combustor. A fire pot is positioned in the combustor and defines a combustion chamber with a combustion throat at one end and a choke at a second end between the combustion chamber and the coil bank. The choke is formed of refractory material and includes uniformly distributed steel fibers that conduct heat across the choke from the hot side adjacent the combustion chamber to the cooler side adjacent the coil bank. The steel fibers substantially reduce the thermal gradient in the choke and improve boiler efficiency.

6 Claims, 3 Drawing Figures

REFRACTORY CHOKE FOR A HIGH INTENSITY COMBUSTOR

BACKGROUND OF THE INVENTION

A. Field of the Invention

The present invention relates to a new and improved refractory choke for a high intensity combustor; and more particularly, to a new and improved choke of refractory material including elements for improving the thermal conductivity of the refractory material and to a new and improved method for improving the combustion of a boiler.

B. Description of the Background Art

Boilers and steam generators typically include a combustor. A fire pot is included in the combustor with a throat at one end and a choke fabricated of refractory material at a second end. Combustion occurs in the fire pot and in high intensity combustors, temperatures in the fire pot reach 2500° F. During combustion, recirculation of gases occurs in the fire pot and hot gases pass through the choke to a part of the boiler including a coil bank or heat exchanger. One side of the choke is exposed to high temperature combustion and the other side, outside the fire pot, experiences lesser temperatures of 200° F. The massive refractory choke has a very low thermal conductivity of about 1.8 BTU/hr. ft.$^2$°F./ft. This combination of high temperatures and low thermal conductivity causes very high thermal gradients which in turn cause cyclic thermal strain resulting in destructive structural failure or cracks throughout the refractory choke.

In addition to cracks, surface spalling and disintegration of the face of the choke facing the interior of the fire pot occurs. This destruction of the face of the choke weakens and sometimes destroys recirculation in the fire pot. Since reduced recirculation results in a greater proportion of unburned fuel particles, the weakened or destroyed recirculation substantially decreases the efficiency of the boiler.

Present practice has been to reduce the flame temperature gradients to avoid damage to the choke. Reduction of flame temperature is typically accomplished by using larger amounts of combustion air. This procedure, however, reduces combustion efficiency and increases the formation of pollutants that are discharged into the atmosphere.

In the area of reinforced materials, there have been efforts to mix steel pins into concrete for the purpose of strengthening the structure formed of the concrete. Examples of reinforced concrete to prevent cracking due to the application of tensile or thermal stress are disclosed in U.S. Pat. Nos. 3,429,094 and 3,500,728. These patents are directed to strength enhancement and do not improve performance of a combustion system or improve thermal conductivity.

SUMMARY OF THE INVENTION

An object of the present invention is to provide a new and improved choke for a high intensity combustor in a boiler.

Another object of the present invention is to provide a new and improved choke for a high intensity combustor that includes structure for reducing the thermal gradient across the choke.

A further object of the present invention is to provide a method for improving the combustion efficiency in a high intensity combustor.

A still further object of the present invention is to provide a method and structure that prevents the deterioration of the coke of a high intensity combustor thereby improving the efficiency of the combustor.

Briefly, the present invention is directed to a new and improved boiler that includes a high intensity combustor. A fire pot is located in the combustor with a throat at a first end and a refractory choke at a second end. Combustion occurs in a combustion chamber defined in the fire pot between the throat and the choke. The choke promotes recirculation in the combustion chamber and is exposed to substantial temperatures that create a thermal gradient across the choke.

In accordance with the principles of the present invention, a plurality of stainless steel pins are randomly mixed or distributed throughout the refractory material of the choke and serve to enhance the travel of heat through the choke reducing the temperature gradient. The use of steel pins to increase effective conductivity of the refractory choke, reduces the gas ablation damage to the face of the choke adjacent the combustion chamber which promotes recirculation zones in the combustion chamber insuring a complete burning of fuel particles.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
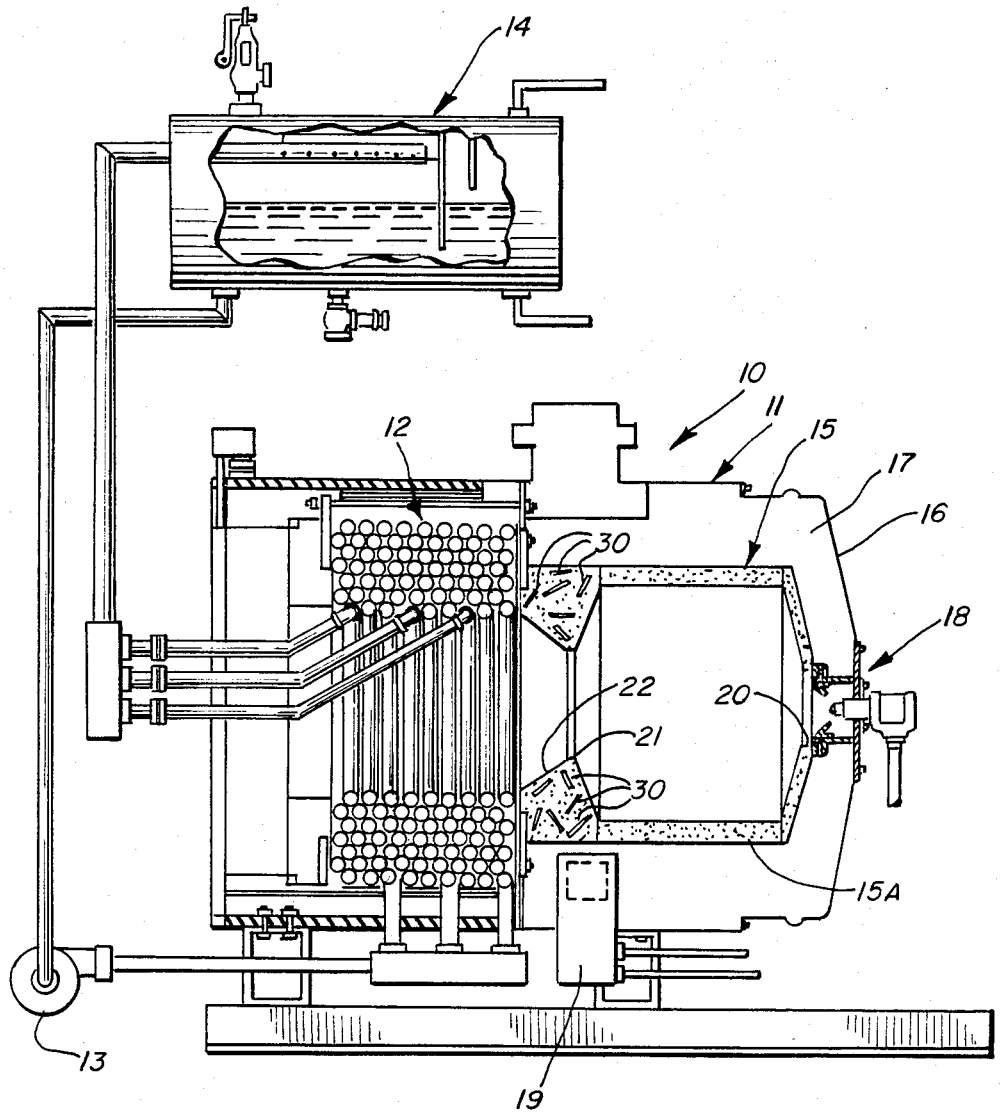
FIG. 1 is an elevational view of a system including a choke constructed in accordance with the principles of the present invention.

Referring to the drawings and initially to FIG. 1, there is illustrated a steam generator generally designated by the reference numeral 10. Steam generator 10 is generally described in U.S. Pat. No. 3,226,038 and this patent is incorporated by reference. Generator 10 is a high heat release system that releases heat on the order of two to five times greater than comparable generators. Steam generator 10 includes a combustor 11 in which combustion occurs to generate hot gases for heating water flowing through heat exchanger or coils 12. Water and steam are pumped through coils 12 by a pump 13 and steam is separated from water in a drum 14.

Combustor 11 includes a fire pot 15 surrounded by a casing 16 that defines a plenum chamber 17 and includes a burner assembly 18. Plenum chamber 17 is supplied with air by a blower 19. Fire pot 15 consists of a refractory lined can 15A with a throat 20 at one end and a choke 21 at the other end. Choke 21 includes a flared back surface 22 to properly distribute heat energy issuing from fire pot 15 into the heat exchange area of the steam generator where coils 12 are located.

Choke 21 is a restriction in the path of flow of combustion gases strategically placed in the system to promote recirculation zones 24. The recirculation zones 24 are formed by vortexes that mix unburned particles to obtain more complete burning. Without recirculation zones 24, there is carbon buildup on the choke 21 causing a back up in the flow and reduced efficiency of boiler 10.

Combustion refractory, such as is in choke 21, is subject to external and internal cracking due to large thermal stress gradients. These large gradients are caused by thick and odd shaped structures such as choke 21 with low thermal conductivity. Cracking is most severe during heat up and cool down periods occurring due to changing steam loads on the boiler or generator 10. At these times the rate of temperature gradient change is the fastest.

Figure 2:
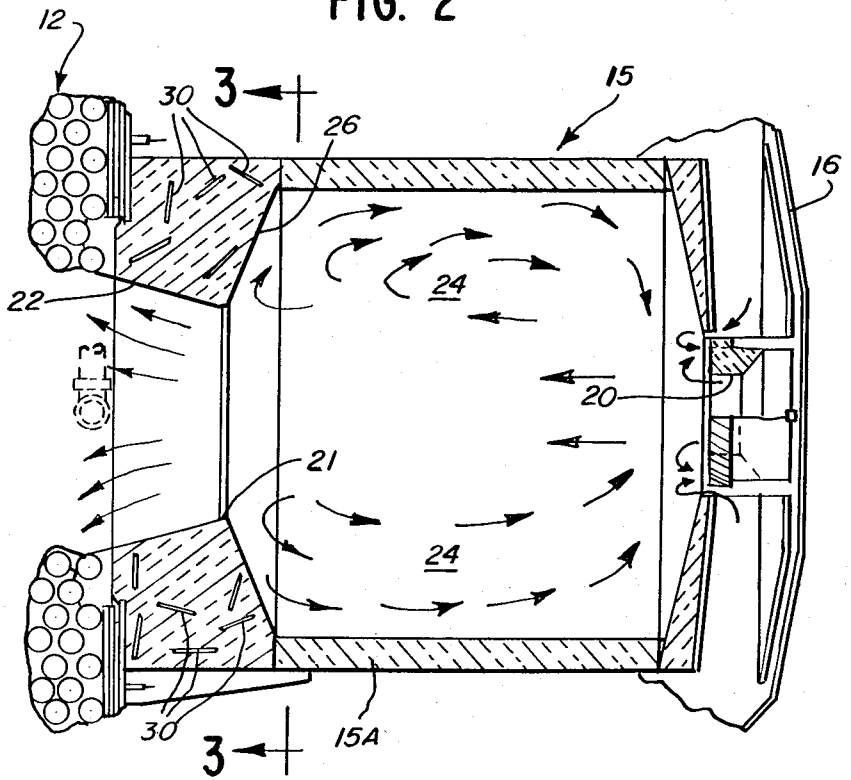
FIG. 2 is a cross sectional view of a fire pot including the choke of the present invention.

Referring to FIG. 2, the face 26 of choke 21 is exposed to temperatures from 2500° F. to 3000° F. resulting in high heat fluxes which try to pass through the massive choke 21. The resultant thermal shock and ensuing temperature strain causes destructive cracks in choke 21.

Figure 3:
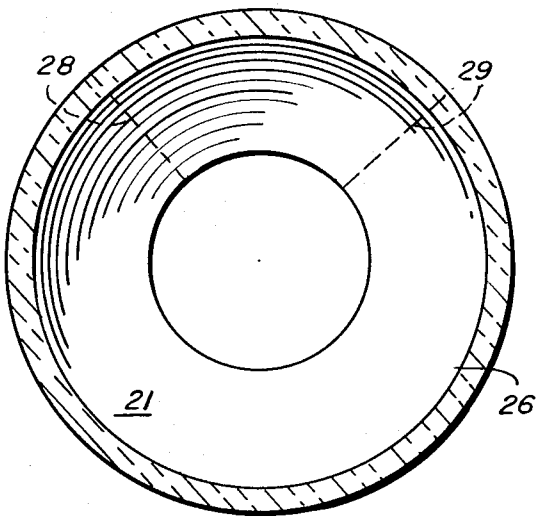
FIG. 3 is a view taken along line 3—3 of FIG. 2.

The high temperatures exposed to face 26 of choke 21 also cause surface spalling and disintegration of surface 26 primarily between dotted lines 28 and 29 in FIG. 3. This damage to surface 26 weakens and sometimes destroys recirculation zones 24 resulting in a decrease in boiler efficiency.

To decrease these thermal gradients, stainless steel pins, rods, ribbons or fibers 30 are randomly mixed in the refractory of the choke 21 as it is being poured. The steel fibers 30 provide an easier path (path of least resistance) for heat to travel from face 26 of choke 21 to the cool side of choke 21. Since the thermal conductivity of stainless steel fibers is about 25 to 30 Btu/hr. $ft^2$°F./ft., heat travels substantially faster through choke 21 with fibers 30. Moreover, since fibers 30 are randomly positioned in choke 21, heat is diffused and travels rapidly in all directions.

A secondary advantage of using the stainless steel fibers 30 is the ability of the fibers 30 to hold the refractory material together in the event of unforeseen thermal and/or mechanical strains which may produce cracking. The primary advantages, however, are increased life of choke 21 and improved combustion in boiler 10.

Many modifications and variations to the present invention are possible in light of the above teachings. Thus, it is to be understood that, within the scope of the appended claims, the invention may be practiced other than as specifically described.

What is claimed and sought to be secured by Letters Patent of the United States is:

1. A boiler comprising;

a shell, a high intensity combustor mounted in said shell, a coil bank in said shell, a fire pot defining a combustion chamber in said combustor, said fire pot fabricated of refractory material, a combustion throat at a first end of said fire pot, a choke having inner and outer diameters, in a position to be exposed to high temperature combustion gases, said gases establishing a steady state radial thermal gradient, said gradient decreasing from said inner to outer diameters, said choke being of refractory material consisting principally of the oxides and magnesium, aluminum, and silicon, and including stainless steel material for increasing the thermal conductivity of said refractory material and reducing said gradient, said metallic material uniformly distributed in said refractory.

2. The boiler set forth in claim 1 wherein said metallic fibers are stainless steel ribbons.

3. The boiler set forth in claim 1 wherein said metallic fibers are stainless steel rods.

4. The boiler set forth in claim 1 wherein said choke is precast.

5. A steam generator, comprising;

a shell, a high intensity combustor in said shell, said combustor includes a fire pot, said fire pot includes a throat at a first end and a refractory material choke at a second end, said choke including a choke body, and means for rapid heat conduction through said choke body comprising;

a somewhat cylindrical refractory choke body having a truncated trapezoidal cross-section, said refractory principally composed of the oxides of magnesium, aluminum, and silicon;

a plurality of randomly distributed stainless steel metallic members throughout said body, thereby defining a composite combustor choke;

wherein said composite choke reduces radial thermal gradient across said choke cross-section.

6. The steam generator claimed in claim 5 wherein said heat conduction means includes a plurality of stainless steel pins in said refractory material.

* * * * *